US009046316B1

(12) United States Patent
Young

(10) Patent No.: US 9,046,316 B1
(45) Date of Patent: Jun. 2, 2015

(54) FIREARM SUPPRESSOR WITH DYNAMIC BAFFLES

(71) Applicant: Nolan Blake Young, Eagle, ID (US)

(72) Inventor: Nolan Blake Young, Eagle, ID (US)

(73) Assignee: GEMINI TECHNOLOGIES, Eagle, ID (US)

( * ) Notice: Subject to any disclaimer, the term of this patent is extended or adjusted under 35 U.S.C. 154(b) by 16 days.

(21) Appl. No.: 14/171,908

(22) Filed: Feb. 4, 2014

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/00
USPC ..... 181/223, 225, 212; 89/14.4
See application file for complete search history.

(56) References Cited

U.S. PATENT DOCUMENTS 3,219,141 A * 11/1965 Williamitis ..... 181/269
3,748,956 A * 7/1973 Hubner ..... 89/14.4
6,158,082 A * 12/2000 Beckey et al. ..... 15/326
7,621,370 B2 * 11/2009 Abe et al. ..... 181/204
8,381,871 B1 * 2/2013 Hellie et al. ..... 181/250
8,813,708 B2 * 8/2014 Miller et al. ..... 123/184.22
2006/0096805 A1 * 5/2006 Staut ..... 181/271
2007/0107981 A1 * 5/2007 Sicotte ..... 181/237
2010/0212999 A1 * 8/2010 Marion et al. ..... 181/250
2014/0262604 A1 * 9/2014 Proske ..... 181/223
2014/0374189 A1 * 12/2014 Young et al. ..... 181/223

* cited by examiner

*Primary Examiner* — Forrest M Phillips
(74) *Attorney, Agent, or Firm* — Parsons Behle & Latimer

(57) ABSTRACT

A suppressor for a firearm having dynamic baffles that move together during the discharge of a firearm. A dynamic baffle assembly may be positioned within a housing that may be connected to a barrel of a firearm. A projectile path passes between dynamic baffles of positioned within the housing. The dynamic baffles include engaging faces that are adapted to permit the passage of the projectile through the dynamic baffles. The gas created from the discharge of ammunition impinges upon the engaging faces causing the movement of the dynamic baffles towards each other. The movement of the dynamic baffles may slow the flow of gases created by the discharge of ammunition and reduce the noise created during the discharge of a firearm.

20 Claims, 5 Drawing Sheets

FIREARM SUPPRESSOR WITH DYNAMIC BAFFLES

FIELD OF THE DISCLOSURE

The embodiments described herein relate to a firearm suppressor with dynamic baffles.

BACKGROUND

Description of the Related Art

A suppressor may be used to reduce the noise made during the discharge of a firearm. One example of a prior firearm suppressor is a housing that includes a series of baffles positioned within the housing. For example, the housing, also referred to as a can, may include a series of k-type baffles positioned within the can. The baffles are constructed to provide a series of chambers that permit the contraction and expansion of the gas created by the discharge of ammunition. In order to adequately suppress the discharge of a firearm, the suppressor may require a number of these baffles leading to a longer suppressor. It may be desirable to decrease the length as well as the weight of a suppressor.

A wipe type firearm suppressor may typically be shorter in length then suppressor utilizing k-type baffles. Wipe suppressors generally use material positioned within the suppressor to dampen the sound from a discharge firearm. Examples of such material may be fabric or leather. However, typically the material within the suppressor touches the projectile as it travels through the suppressor, which may not be desirable for a number of reasons. For example, the material touching the projectile may adversely affect the accuracy of the firearm used with a wipe suppressor. Furthermore, each time a projectile is fired through a wipe suppressor, a portion of the dampening material is removed with the projectile. The removal of the material with each discharge reduces the effectiveness of the suppression of noise provided by the suppressor for subsequent discharges. Some wipe suppressors may even become ineffective after the discharge of a few magazines of ammunition.

Accordingly, there is a need to provide firearm suppressor that is shorter in length, lighter in weight, and may be effective over a large number of discharges. Other drawbacks and disadvantages of present suppressor systems also exist.

SUMMARY

The present disclosure is directed to a firearm suppressor with dynamic baffles that address some of the problems and disadvantages discussed above.

One embodiment is a suppressor for a firearm comprising a housing having a first end and a second end. The first end of the housing being configured to mate with a barrel of a firearm and having a first opening and the second end of the housing having a second opening. The suppressor comprises a base selectively connectable to the housing, the base having an opening through the base. The suppressor comprises a first baffle that extends from the base to a location within the housing and a second baffle that extends from the base to a location within the housing. The suppressor comprises a projectile path between the first and second baffles and wherein the first and second baffles are configured to move towards each other during a discharge of the firearm and movement of a projectile along the projectile path.

A portion of the base may include threads adapted to engage threads on a portion of the housing. The first baffle may include a first engaging face positioned at the end of the first baffle, the first engaging face extending towards the projectile path and the second baffle may include a second engaging face positioned at the end of the second baffle, the second engaging face extending towards the projectile path. There may be a first distance between the first engaging face and the second engaging face that decreases during the discharge of the firearm. The first engaging face may include a first notch adjacent to the projectile path and the second engaging face may include a second notch adjacent to the projectile path.

The first baffle may include a third engaging face positioned along the first baffle, the third engaging face extending towards the projectile path and the second baffle may include a fourth engaging face positioned along the second baffle, the fourth engaging face extending towards the projectile path. There may be a second distance between the third engaging face and the fourth engaging face that decreases during the discharge of the firearm. The third engaging face may include a third notch adjacent to the projectile path and the fourth engaging face may include a fourth notch adjacent to the projectile path.

The first baffle may include a fifth engaging face positioned along the first baffle, the fifth engaging face extending towards the projectile path and the second baffle may include a sixth engaging face positioned along the second baffle, the sixth engaging face extending towards the projectile path. There may be a third distance between the fifth engaging face and the sixth engaging face that decreases during the discharge of the firearm. The fifth engaging face may include a fifth notch adjacent to the projectile path and the sixth engaging face may include a sixth notch adjacent to the projectile path.

One embodiment is a suppressor for a firearm that comprises a housing adapted to be connected to a barrel of a firearm, the housing having a projectile path through the housing and a first set of dynamic baffles positioned within the housing, the first set of dynamic baffles positioned about the projectile path. During a discharge of the firearm at least a portion of the first set of dynamic baffles moves towards the projectile path.

The first set of dynamic baffles may include a first dynamic baffle and a second dynamic baffle with the projectile path being positioned between the first and second dynamic baffles. The first set of dynamic baffles may include a first dynamic baffle, a second dynamic baffle, and a third dynamic baffle with the projectile path being positioned between the first, second, and third dynamic baffles. The first dynamic baffle may include a first engaging face positioned at the end of the first dynamic baffle, the first engaging face extending towards the projectile path, the second dynamic baffle may include a second engaging face positioned at the end of the second dynamic baffle, the second engaging face extending towards the projectile path, and the third dynamic baffle may include a third engaging face positioned at the end of the third dynamic baffle, the third engaging face extending towards the projectile path. During the discharge of the firearm the first engaging face, the second engaging face, and the third engaging face may each move towards the projectile path. The suppressor may include a second set of dynamic baffles positioned within the housing. The second set of dynamic baffles may be positioned in tandem with the first set of dynamic baffles about the projectile path. During the discharge of the firearm, at least a portion of the second set of dynamic baffles may move towards the projectile path.

One embodiment is a method of suppressing a sound of discharging a firearm comprising positioning a first set of dynamic baffles within a housing that is adapted to be connected to a barrel of a firearm. The method comprises connecting the housing to the barrel of a firearm, discharging the firearm, and moving at least a portion of the first set of dynamic baffles towards each other, wherein the first set of dynamic baffles reduces the sound of the discharging firearm. The method may include positioning a second set of dynamic baffles within the housing and moving at least a portion of the second set of dynamic baffles toward each other, wherein the first and second set of dynamic baffles reduce the sound of the discharging firearm. The first set of dynamic baffles may include a first baffle, a second baffle, and a third baffle positioned along a projectile path within the housing.

Figure 1:
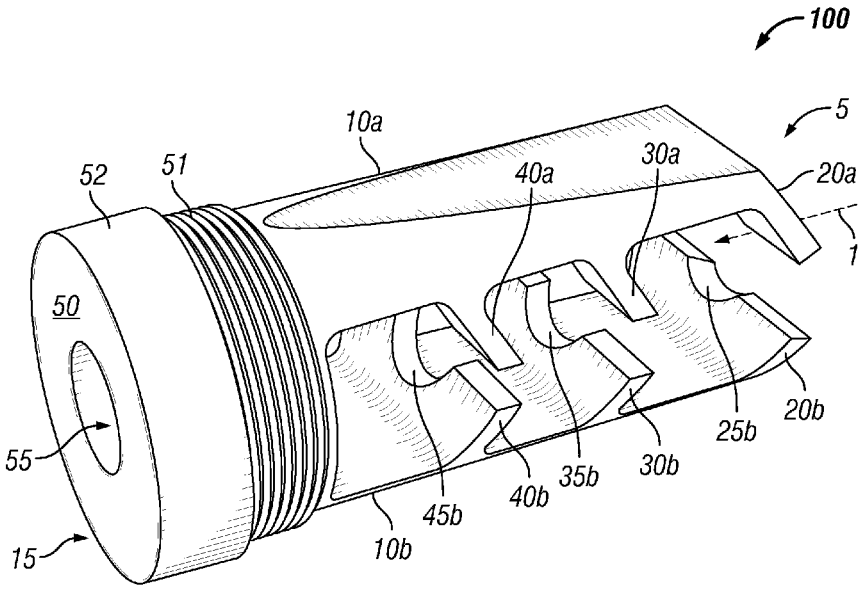
FIG. 1 shows one embodiment of a dynamic baffle assembly for a firearm suppressor.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows one embodiment of a dynamic baffle assembly 100 that may be used in connection with a housing 200 (shown in FIG. 2) to form a suppressor that may be used reduce the sound of the discharge of a firearm. The baffle assembly 100 includes threads 51 on the base 50 that may be used to connect the assembly 100 to a housing 200 to form a firearm suppressor as discussed in detail herein. A flange 52 on the base 50 may be adapted to engage the end of the housing 200 as shown in FIG. 3. The dynamic baffle assembly 100 includes a first dynamic baffle 10*a* and a second dynamic baffle 10*b* that both extend along the centerline of the assembly 100 from a base 50 of the assembly 100. In some embodiments, the baffles 10*a* and 10*b* are cantilever structures that extend from the base 50. In other words, the baffles 10*a* and 10*b* are fixed at one end and are free are the other end permitting the dynamic movement of the baffles 10*a* and 10*b* during the discharge of a firearm. The dynamic nature of the baffles 10*a* and 10*b* has been shown to aid in the suppression of noise during the discharge of a firearm. The baffles 10*a* and 10*b* are dynamic because they are adapted to move towards each other during the discharge of a firearm and move away from each other to the initial positions after the discharge of the firearm. The gas from the discharge of ammunition may impinge upon various surfaces on the baffles 10*a* and 10*b* causing the baffles 10*a* and 10*b* to move towards a projectile path 1 that travels along the length of the baffle assembly 100 between the two dynamic baffles 10*a* and 10*b*. The baffles 10*a* and 10*b* may comprise a material with sufficient resilience that they spring away from the projectile path 1 back to their rest or initial positions after discharge. The dynamic baffles may be comprised of various materials. For example, the dynamic baffles may be comprised of aluminum and/or titanium.

As discussed in detail herein, a projectile fired from a firearm travels along a projectile path 1 that enters the baffle assembly 100 at a front end 5 of the assembly. The projectile travels along the length of the assembly 100 between the two dynamic baffles 10*a* and 10*b* and out of the base 50 of the assembly 100 through an opening 55 in the base 50 at the rear end 15 of the assembly 100.

The baffles 10*a* and 10*b* may include a plurality of surfaces that are adapted to cause the two baffles 10*a* and 10*b* to move towards the projectile path 1 during the discharge of a firearm. The first baffle 10*a* may include a first engaging face 20*a* located at the front end of the baffle 10*a*. Likewise, the second baffle 10*b* may include a first engage face 20*b* located at the front end of the baffle 10*b*. The engaging faces 20*a* and 20*b* project from the centerline of the baffles 10*a* and 10*b* towards each other or towards the projectile path 1. The engaging faces 20*a* and 20*b* are spaced apart an initial distance that permits the passage of a projectile between the two engaging faces. The engaging faces 20*a* and 20*b* may include notches 25*a* and 25*b* to aid in the passing of a projectile between the two engaging faces 20*a* and 20*b*. The engaging faces 20*a* and 20*b* are adapted so that gas created from the discharge of ammunition acts upon the engaging faces 20*a* and 20*b* to cause the engaging faces to move towards each other or towards the projectile path 1. For example, the engaging faces 20*a* and 20*b* may extend from the centerline of their respective baffles 10*a* and 10*b* at an angle between 90 and 175 degrees and may preferably extend from their respective baffles at an angle between 100 and 150 degrees.

In addition to the engaging faces 20*a* and 20*b* located at the end of the baffles 10*a* and 10*b*, each baffle 10*a* and 10*b* may include a plurality of engaging faces 30*a*, 30*b*, 40*a*, and 40*b* that extend from the centerline of their respective baffles towards the projectile path 1. Each of the engaging faces 20*a*, 20*b*, 30*a*, 30*b*, 40*a*, and 40*b* is adapted to permit the passage of a projectile through the baffle assembly 100 while being adapted to dynamically cause the baffles 10*a* and 10*b* to move towards each other during the discharge of ammunition from a firearm. The engaging faces 20*a*, 20*b*, 30*a*, 30*b*, 40*a*, and 40*b* may include notches 25*a*, 25*b*, 35*a*, 35*b*, 45*a*, and 45*b* that aid in the passage of the projectile through the dynamic baffle assembly 100. The engaging faces 20*a*, 20*b*, 30*a*, 30*b*, 40*a*, and 40*b* may be configured with notches to still permit the passage of a projectile while dynamically causing the baffles 10*a* and 10*b* to move towards the projectile path 1 during the discharge of the firearm. The number of engaging faces, location of engaging faces, and orientation of the engage faces are shown for illustrative purposes only and may be varied as would be appreciated by one of ordinary skill in the art having the benefit of this disclosure. Likewise, the number, shape, and location of notches (e.g., 25*a*, 25*b*, 35*a*, 35*b*, 45*a*, 45*b*) may also vary.

Figure 2:
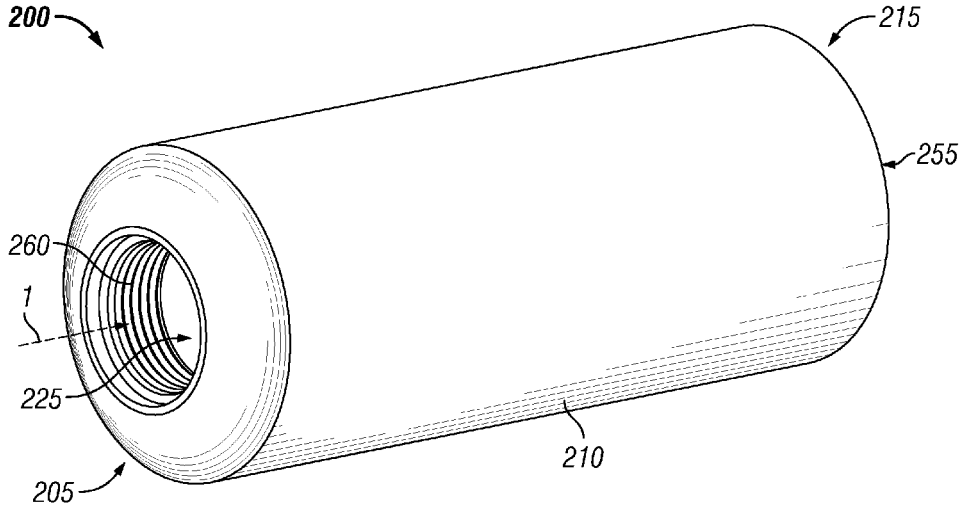
FIG. 2 shows one embodiment of a housing for a firearm suppressor having dynamic baffles.
Figure 3:
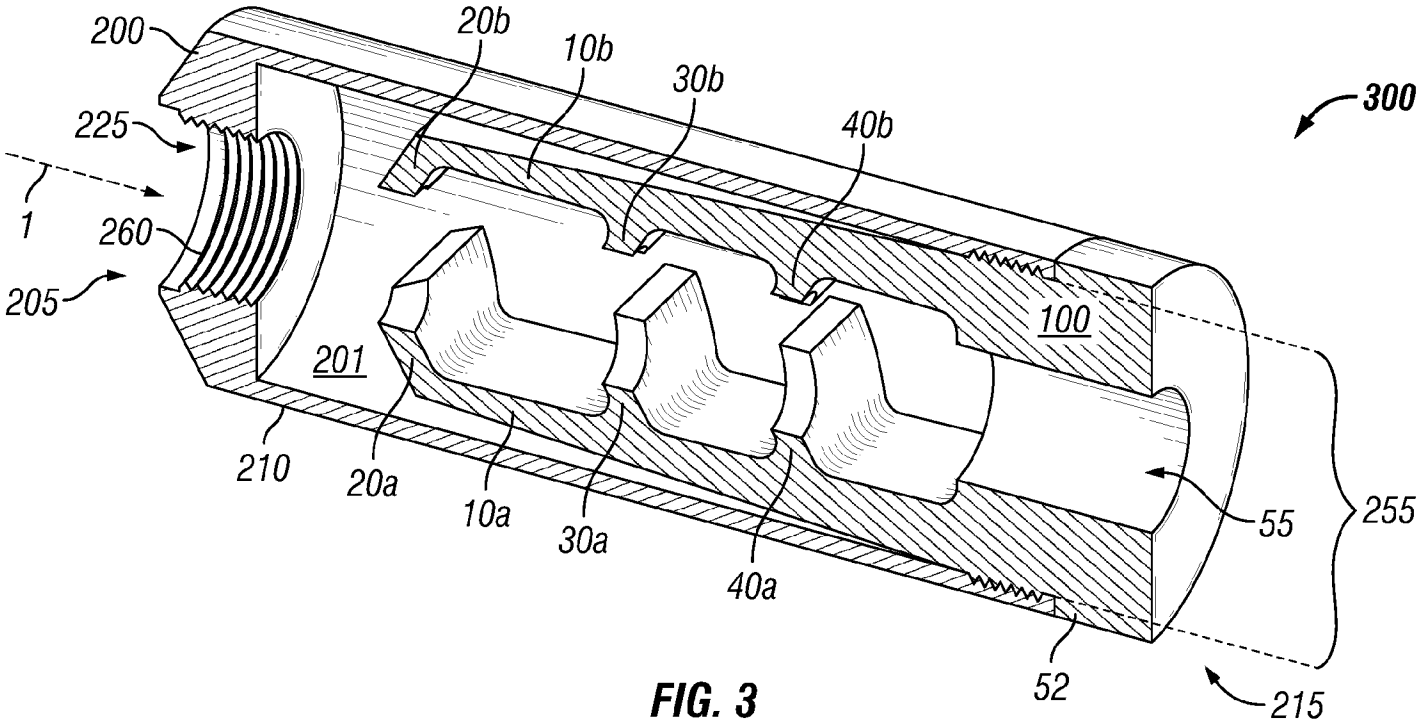
FIG. 3 shows one embodiment of firearm suppressor having dynamic baffles.

FIG. 2 shows one embodiment of a housing 200 that may be used to house a dynamic baffle assembly. The housing 200 includes an opening 225 in the front end 205. Threads 260 in the opening 225 may permit the threading of the housing 200 onto a barrel of a firearm. As shown by projective path 1, a projectile fired from a firearm enters the housing 200 through the opening 225 and exits the housing 200 through an opening 255 in the second end 215. A dynamic baffle assembly may be inserted into a cavity 201 (shown in FIG. 3) within the body 210 of the housing 200.

FIG. 3 shows a cross-section view of a suppressor 300 that comprises a dynamic baffle assembly 100 connected to a housing 200. The dynamic baffle assembly 100 is inserted into the cavity 201 of the housing 200 via the opening 255 in the rear end 215 of the housing 200. The dynamic baffle assembly 100 is threaded into the housing 200. As discussed above, the suppressor 300 may be threaded onto a barrel of a firearm via the threads 260 within the opening 225 on the front end 205 of the housing 200. Once thread onto the barrel of a firearm, a projectile fired from the firearm during discharge will travel into the suppressor 300 via the opening 225 as shown by the projectile path 1. The projectile will continue within the housing 200 between the two dynamic baffles 10*a* and 10*b* and out of the suppressor 300 via the opening 55 in the rear end of the dynamic baffle assembly 100, which is positioned within the opening 255 at the rear end 215 of the housing 200. The pressure wave from the gas from the discharged ammunition impinges on the engaging faces 20*a*, 20*b*, 30*a*, 30*b*, 40*a*, and 40*b* of the dynamic baffles 10*a* and 10*b* causing movement of the dynamic baffles 10*a* and 10*b* towards the projectile path 1 along the centerline of the suppressor 300. The movement of the dynamic baffles 10*a* and 10*b* reduces the noise from the discharge of the firearm by partially obturating the gases from the bore axis. The movement of the dynamic baffles 10*a* and 10*b* eliminates the need to include a large number of chambers within the suppressor to reduce the noise from the discharge. Also the dynamic baffles 10*a* and 10*b* do not touch the projectile as it passes through the suppressor providing adequate noise reduction over the repeated discharge of a firearm.

Figure 4:
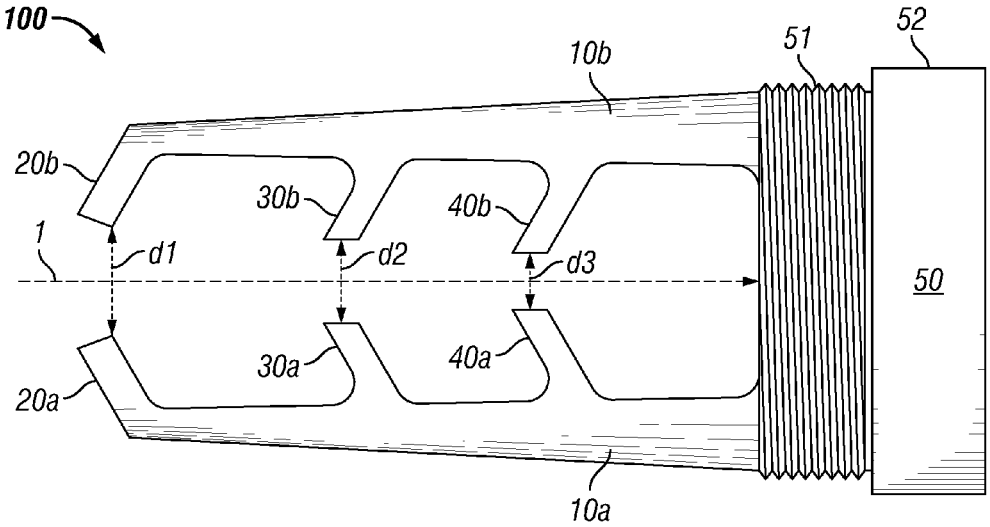
FIG. 4 shows one embodiment of a dynamic baffle prior to discharging a firearm.

FIG. 4 shows a side view of an embodiment of a dynamic baffle assembly 100 in an initial state prior to the discharge of a firearm. There is an initial distance d1 between engaging faces 20*a* and 20*b*. Likewise, there is an initial distance d2 between engaging faces 30*a* and 30*b* and an initial distance d3 between engaging faces 40*a* and 40*b*. FIG. 4 shows that projectile path 1 between the two dynamic baffles 10*a* and 10*b*. The projectile continues to travel out of the dynamic baffle assembly 100 out of the opening out of the base 50 via opening 55 (shown in FIG. 1).

Figure 5:
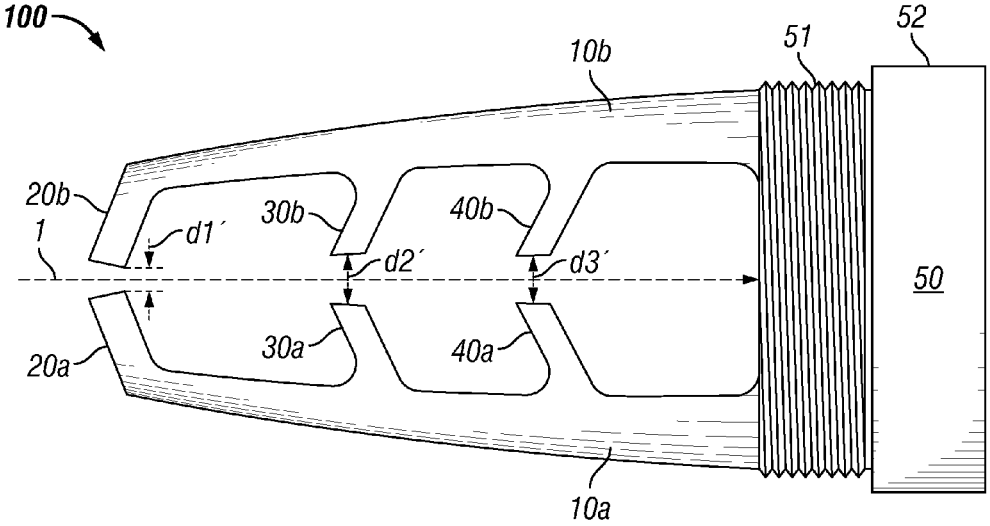
FIG. 5 shows dynamic baffle of FIG. 4 during the discharge of a firearm.

FIG. 5 shows the dynamic baffle assembly 100 of FIG. 4 during the discharge of a firearm. The baffles 10*a* and 10*b* have move towards the projectile path 1. There is a new distance d1' between engaging faces 20*a* and 20*b*. Likewise, there is a new distance d2' between engaging faces 30*a* and 30*b* and a new distance d3' between engaging faces 40*a* and 40*b*. In some embodiments, engaging faces 20*a* and 20*b* may actually touch together during the discharge of the firearm. The use of notches in the engaging faces 20*a*, 20*b*, 30*a*, 30*b*, 40*a*, and 40*b* may permit a very small distance between the engaging faces 20*a*, 20*b*, 30*a*, 30*b*, 40*a*, and 40*b* during the discharge of a firearm. The distances d1', d2', and d3' are smaller than the distances d1, d2, and d3, respectively. The actual change in distances may vary depending on the ammunition and amount of suppression desired as would be appreciated by one of ordinary skill in the art having the benefit of this disclosure. After the discharge of the firearm, the baffles 10*a* and 10*b* return to the positions shown in FIG. 4.

Figure 6:
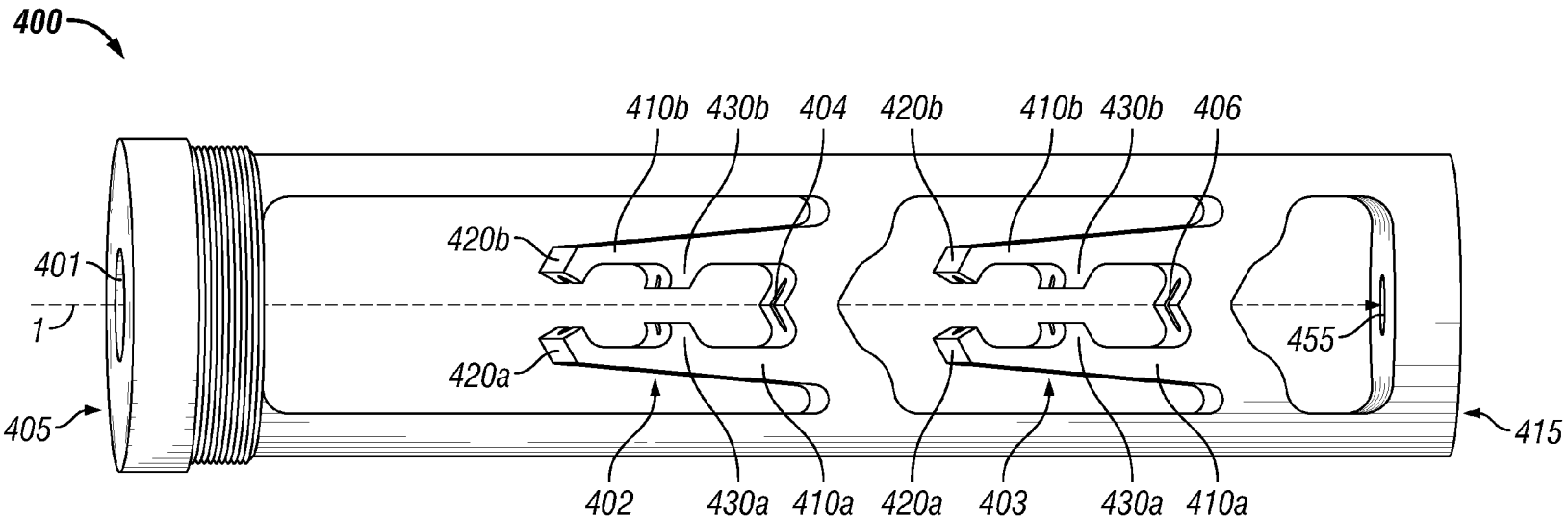
FIG. 6 shows one embodiment of a dynamic baffle assembly.

FIG. 6 shows an embodiment of a dynamic baffle assembly 400 having more than one set of dynamic baffles. The dynamic baffle assembly 400 includes an opening 401 at the front end 405 that permits the entrance of a projectile fired from a firearm to enter the assembly 400. The projectile travels along the projectile path 1 through a first set of dynamic baffles 402, through a second set of dynamic baffles 403, and out of an opening 455 in a rear end 415 of the assembly 400.

The first set of baffles 402 includes a first dynamic baffle 410*a* and a second dynamic baffle 410*b* that includes a plurality of engaging faces 420*a*, 420*b*, 430*a*, and 430*b* that are adapted to cause the dynamic baffles 410*a* and 410*b* to move towards each other during the discharge of a firearm. The projectile travels between the baffles 410*a* and 410*b* in the first set of dynamic baffles 402 and out an opening 404 at the bottom to enter into the second set of dynamic baffles 403. The second set of baffles 403 also includes a first dynamic baffle 410*a* and a second dynamic baffle 410*b* that includes a plurality of engaging faces 420*a*, 420*b*, 430*a*, and 430*b* that are adapted to cause the dynamic baffles 410*a* and 410*b* to move towards each other during the discharge of a firearm. The projectile travels between the baffles 410*a* and 410*b* in the second set of dynamic baffles 403 and out an opening 406 at the bottom of the second set of dynamic baffles 403. The projectile then exits the dynamic baffle assembly 400 via opening 455 in the rear end 415 of the assembly. The assembly 400 could include addition sets of dynamic baffles as deemed necessary as would be appreciated by one of ordinary skill in the art having the benefit of this disclosure. The dynamic baffle assembly 400 may be inserted into and selectively connected to a housing to form a suppressor having dynamic baffles.

Figure 7:
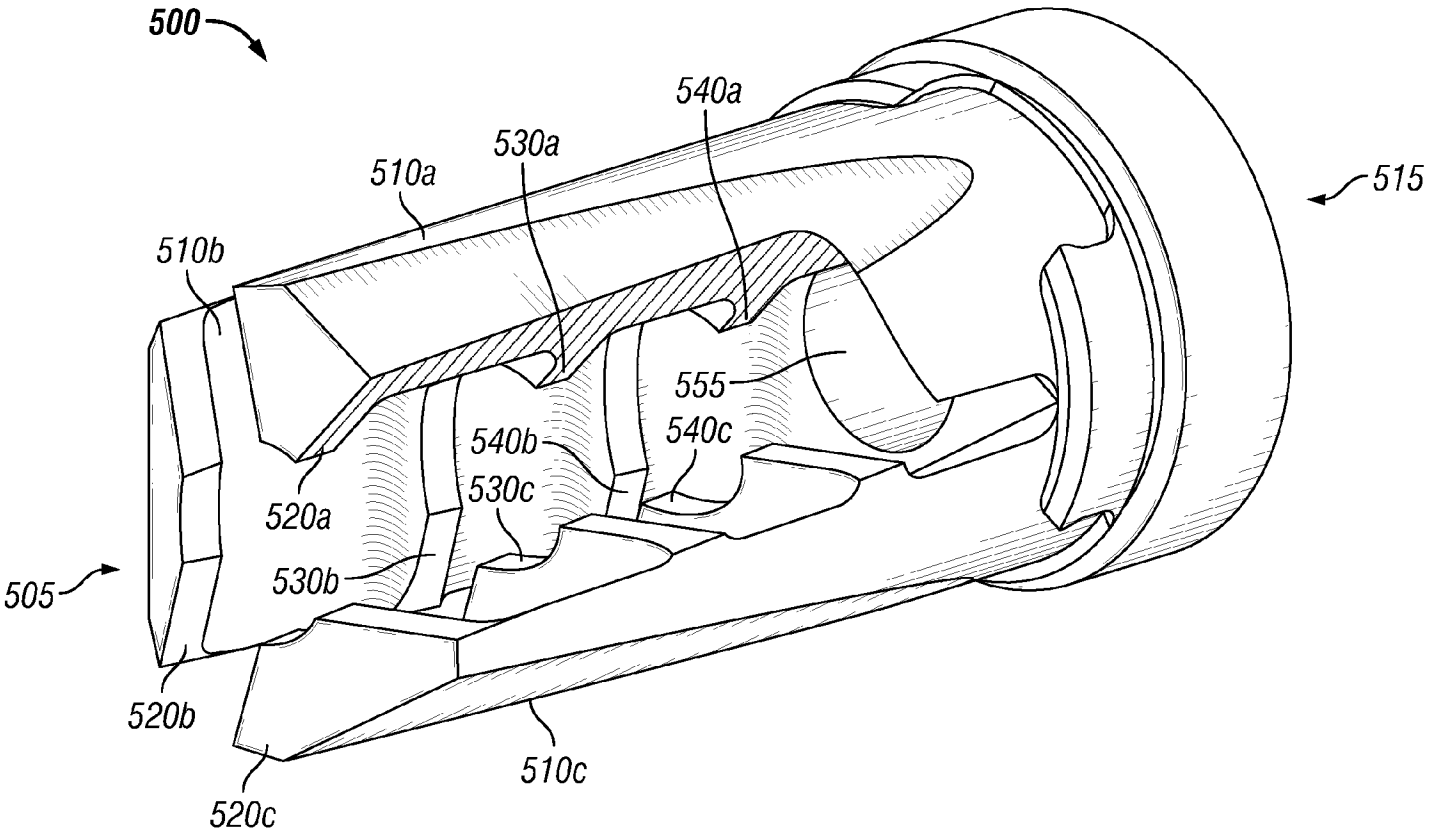
FIG. 7 shows one embodiment of a dynamic baffle assembly.

FIG. 7 shows an embodiment of a dynamic baffle assembly 500 having a first dynamic baffle 510*a*, a second dynamic baffle 510*b*, and a third dynamic baffle 510*c*. A projectile enters the dynamic baffle assembly 500 at a front end 505 of the assembly 500 and travels between the dynamic baffles 510*a*, 510*b*, and 510*c* and out the assembly 500 through an opening 555 in the rear end 515 of the assembly 500. Each of the dynamic baffles 510*a*, 510*b*, and 510*b* may include engaging faces 520*a*, 520*b*, 520*c*, 530*a*, 530*b*, 530*c*, 540*a*, 540*b*, and 540*c* that are adapted to move the dynamic baffles 510*a*, 510*b*, and 510*c* toward each other during the discharge of a firearm. The movement of the dynamic baffles 510*a*, 510*b*, and 510*c* reduces the noise created from the discharge of the firearm. The movement of the dynamic baffles 510*a*, 510*b*, and 510*c* may remove some of the energy in the gas created during the discharge of ammunition.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof

TABLE OF REFERENCE NUMERALS FOR FIGS. 1-7

1—projectile path
5—front end of dynamic baffle assembly
10*a*—dynamic baffle
10*b*—dynamic baffle
15—rear end of dynamic baffle assembly
20*a*—engaging face
20*b*—engaging face
25*a*—notch in engaging face
25*b*—notch in engaging face
30*a*—engaging face
30*b*—engaging face
35*a*—notch in engaging face

35*b*—notch in engaging face
40*a*—engaging face
40*b*—engaging face
45*a*—notch in engaging face
45*b*—notch in engaging face
50—base
51—threads on base
52—flange of base
55—opening in base
100—dynamic baffle assembly
200—housing
201—cavity within housing
210—housing body
205—front end of housing
215—rear end of housing
225—opening in front end of housing
255—opening in rear end of housing
260—threads
300—suppressor assembly
400—dynamic baffle assembly
401—opening in front end of dynamic baffle assembly
402—set of dynamic baffles
403—set of dynamic baffles
404—opening in set of dynamic baffles along projectile path
405—front end of dynamic baffle assembly
406—opening in set of dynamic baffles along projectile path
410*a*—dynamic baffle
410*b*—dynamic baffle
415—rear end of dynamic baffle assembly
420*a*—engaging face
420*b*—engaging face
430*a*—engaging face
430*b*—engaging face
500—dynamic baffle assembly
505—front end of baffle assembly
510*a*—dynamic baffle
510*b*—dynamic baffle
510*c*—dynamic baffle
515—rear end of baffle assembly
520*a*—engaging face
520*b*—engaging face
520*c*—engaging face
530*a*—engaging face
530*b*—engaging face
530*c*—engaging face
540*a*—engaging face
540*b*—engaging face
540*c*—engaging face
555—opening in rear end of baffle assembly
d1—initial distance between 20*a* and 20*b*
d2—initial distance between 30*a* and 30*b*
d3—initial distance between 40*a* and 40*b*
d1'—contracted distance between 20*a* and 20*b*
d2'—contracted distance between 30*a* and 30*b*
d3'—contracted distance between 40*a* and 40*b*

What is claimed is:

1. A suppressor for a firearm, the suppressor comprising:

a housing having a first end and a second end, the first end being configured to mate with a barrel of a firearm and having a first opening, the second end having a second opening;

a base selectively connectable to the housing, the base having an opening through the base;

a first baffle, the first baffles extends from the base to a location within the housing;

a second baffle, the second baffles extends from the base to a location within the housing; and a projectile path between the first and second baffles;

wherein the first and second baffle are configured to move towards each other during a discharge of the firearm and movement of a projectile along the projectile path.

2. The suppressor of claim 1, wherein a portion of the base includes threads, the threads being adapted to engage threads on a portion of the housing.

3. The suppressor of claim 2, the first baffle further comprising a first engaging face positioned at an end of the first baffle that extends towards the projectile path and the second baffle further comprising a second engaging face positioned at an end of the second baffle that extends towards the projectile path.

4. The suppressor of claim 3, further comprising a first distance between the first engaging face and the second engaging face, wherein the first distance decreases during the discharge of the firearm.

5. The suppressor of claim 4, further comprising a first notch in the first engaging face adjacent to the projectile path and a second notch in the second engaging face adjacent to the projectile path.

6. The suppressor of claim 4, the first baffle further comprising a third engaging face positioned along the first baffle that extends towards the projectile path and the second baffle further comprising a fourth engaging face positioned along the second baffle that extends towards the projectile path.

7. The suppressor of claim 6, furthering comprising a second distance between the third engaging face and the fourth engaging face, wherein the second distance decreases during the discharge of the firearm.

8. The suppressor of claim 7, further comprising a third notch in the third engaging face adjacent to the projectile path and a fourth notch in the fourth engaging face adjacent to the projectile path.

9. The suppressor of claim 7, the first baffle further comprising a fifth engaging face positioned along the first baffle that extends towards the projectile path and the second baffle further comprising a sixth engaging face positioned along the second baffle that extends towards the projectile path.

10. The suppressor of claim 9, furthering comprising a third distance between the fifth engaging face and the sixth engaging face, wherein the third distance decreases during the discharge of the firearm.

11. The suppressor of claim 10, further comprising a fifth notch in the fifth engaging face adjacent to the projectile path and a sixth notch in the sixth engaging face adjacent to the projectile path.

12. A suppressor for a firearm, the suppressor comprising:

a housing adapted to be connected to a barrel of a firearm, the housing having a projectile path though the housing; and a first set of dynamic baffles positioned within the housing, the first set of dynamic baffles positioned about the projectile path;

wherein during a discharge of the firearm at least a portion of the first set of dynamic baffles moves towards the projectile path.

13. The suppressor of claim 12, wherein the first set of dynamic baffles comprises a first dynamic baffle and a second dynamic baffle, the projectile path being positioned between the first and second dynamic baffles.

14. The suppressor of claim 12, wherein the first set of dynamic baffles comprises a first dynamic baffle, a second dynamic baffle, and a dynamic third baffle, the projectile path being positioned between the first, second, and third dynamic baffles.

15. The suppressor of claim 14, the first dynamic baffle further comprising a first engaging face positioned at an end of the first dynamic baffle that extends towards the projectile path, the second dynamic baffle further comprising a second engaging face positioned at an end of the second dynamic baffle that extends towards the projectile path, and the third dynamic baffle further comprising a third engaging face positioned at an end of the third dynamic baffle that extends towards the projectile path.

16. The suppressor of claim 15, wherein during discharge of the firearm the first engaging face moves towards the projectile path, the second engaging face moves towards the projectile path, and the third engaging face moves towards the projectile path.

17. The suppressor of claim 12, further comprising a second set of dynamic baffles positioned within the housing, the first set of dynamic baffles and the second set of dynamic baffles being positioned in tandem about the projectile path, wherein during the discharge of the firearm at least a portion of the second set of dynamic baffles moves towards the projectile path.

18. A method of suppressing a sound of discharging a firearm, the method comprising:

positioning a first set of dynamic baffles within a housing, wherein the housing is adapted to be connected to a barrel of a firearm;

connecting the housing to the barrel of the firearm;

discharging the firearm; and moving a least a portion of the first set of dynamic baffles toward each other, wherein the first set of dynamic baffles reduces the sound of the discharging firearm.

19. The method of claim 18, further comprising:

positioning a second set of dynamic baffles within the housing;

moving a least a portion of the second set of dynamic baffles toward each other, wherein the first and second sets of dynamic baffles reduce the sound of the discharging firearm.

20. The method of claim 18, wherein the first set of dynamic baffles comprises a first baffle, a second baffle, and a third baffle positioned along a projectile path within the housing.

* * * * *